United States Patent [19]

Finsterwalder et al.

[11] Patent Number: 4,718,965

[45] Date of Patent: Jan. 12, 1988

[54] PROCESS OF MAKING A STRUCTURAL CABLE

[76] Inventors: Ulrich Finsterwalder, Pagodenburgstr. 8, D-8000 München 5; Xaver Lipp, D-7091 Tannhausen, both of Fed. Rep. of Germany

[21] Appl. No.: 770,635

[22] Filed: Aug. 28, 1985

[30] Foreign Application Priority Data

Aug. 30, 1984 [DE] Fed. Rep. of Germany ..... 3431973
Oct. 11, 1984 [DE] Fed. Rep. of Germany ..... 3437350

[51] Int. Cl.[4] ..... B32B 31/04; E01D 11/00

[52] U.S. Cl. ..... 156/294; 14/22; 52/230

[58] Field of Search ..... 14/22, 23; 52/230; 138/158, 163, 168, 175, 176; 29/526 R; 156/91, 304.2, 294, 218, 160, 48, 54; 264/261, 35

[56] References Cited

U.S. PATENT DOCUMENTS

| | | | |
|---|---|---|---|
| 817,314 | 4/1906 | Hahn | 138/158 |
| 3,745,231 | 7/1973 | Eager, Jr. et al. | 156/48 X |
| 4,473,915 | 10/1984 | Finsterwalder | 14/22 X |
| 4,480,348 | 11/1984 | Finsterwalder | 14/18 |
| 4,557,007 | 12/1985 | Daiguji et al. | 52/230 X |
| 4,569,708 | 2/1986 | Tanaka et al. | 156/294 X |

FOREIGN PATENT DOCUMENTS

| | | | |
|---|---|---|---|
| 0869977 | 3/1953 | Fed. Rep. of Germany | 14/22 |
| 1209091 | 1/1966 | Fed. Rep. of Germany . | |
| 0010380 | of 1844 | United Kingdom | 138/167 |
| 0360775 | 11/1931 | United Kingdom | 14/22 |

*Primary Examiner*—Donald E. Czaja
*Assistant Examiner*—Ramon R. Hoch
*Attorney, Agent, or Firm*—Felfe & Lynch

[57] ABSTRACT

A cable for structures, especially suspension bridges, has a plurality of bundled tension elements spacedly surrounded by a tubular sheath, the space between tension elements and sheath being filled with a material, preferably injected mortar. To reduce the cost of producing, transporting and assembling such a cable, the tubular sheath is formed at the worksite from at least one sheet-steel strip in a shaping and seaming station and progressed along already tensioned tension elements, then sealed against anchorings for the cable, and filled with the mortar under pressure.

14 Claims, 8 Drawing Figures

Fig. 7
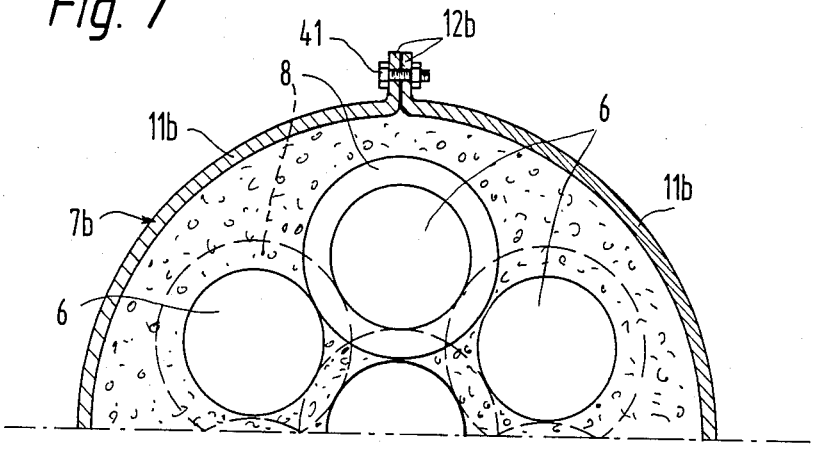
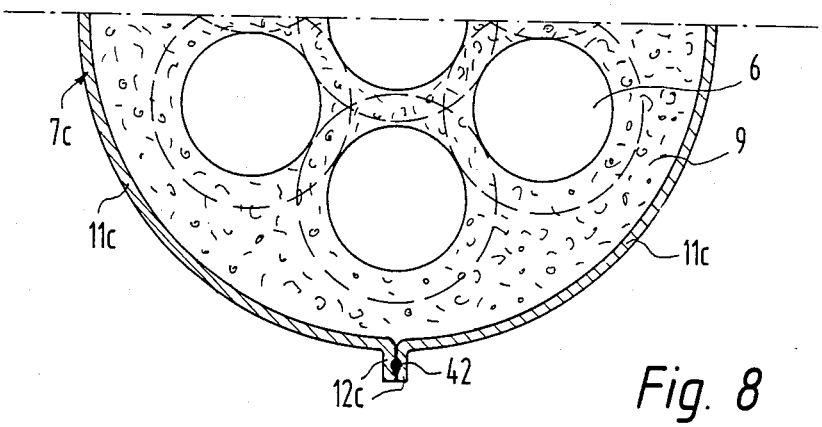
Fig. 8

PROCESS OF MAKING A STRUCTURAL CABLE

BACKGROUND OF THE INVENTION

The invention relates to a cable for a structure, especially a suspension bridge, and a process of making it.

A cable of tension elements inside a sheath with a space therebetween filled with a material, for example, injected mortar, has been found practical for suspending a bridge of prestressed concrete construction. For strength, resistance to corrosion, and ease of anchoring, steel bars and, preferably, threaded steel bars should be used for the tension elements. Under certain circumstances, however, e.g., when there is little or no variation in the sag of the cable, stranded steel cables can be used. Either plastic or steel tubing can be used for the sheath.

Such cables are usually prepared in full at the worksite. The tension elements and sheath, but usually not the material filling the rest of the space in the sheath, can also be preassembled, however, and unwound from a drum at the worksite, for example. In either case, the full length of sheathed tension elements for each cable is laid out, hoisted to its final position between two, end-anchoring points, tensioned, and finally, after the sheath has been closed, cement mortar forced therein.

This cable preparation and installation work is time consuming and calls for a high technical knowledge. For example, sheathing tubes of steel have had to be cleanly welded so as to avoid any point at which corrosion might later attack the cable due to poor welds. Sheathing tubes, whether steel or plastic, have also had to be treated such that they are not damaged, for example when the cable is being unwound from a drum or hoisted into place. Not only can such damage serve as a starting point for later corrosion, as previously mentioned, but also it can affect the tensile strength of the cable. Avoiding damage in unwinding and hoisting the sheathed tension elements is difficult, however, because these are so heavy that heavy equipment must be used in order to handle them. All in all, the above-mentioned difficulties increase the final cost of installing such cable.

The idea of providing a cable having a wrapping about a plurality of thin-wire tension elements after an anticorrosive substance has been applied to the tension elements at the place where the cable is prepared, such as a worksite, for example, is disclosed in German Federal patent publication DE-OS No. 15 51 192. However, to use such a cable in a suspension bridge, it must still be first prepared full-length and then installed as described above and, therefore, with the difficulties mentioned.

SUMMARY OF THE INVENTION

It is, therefore, an object of the invention to devise a cable structure of the type described and a process for making it wherein the process and installation of the cable are simplified as a result of the cable structure.

To this and other ends, a cable has a sheath, preferably of steel, with confronting longitudinal edges folded for bonding the sheath together and at least one tension member inside the sheath with a space between the sheath and tension member for filling with a material such as mortar, for example. The sheath can be, therefore, separately and progressively prepared directly at the worksite in a fixed shaping and folding station.

For ease of shaping the sheath, it is preferably formed from at least two steel strips. These are each shaped semi-cylindrically, half-round in cross section, and their longitudinal edges then confronted and joined together in a folded seam therealong. Preparing the sheath from two steel strips has the advantage that the sheath then comes out of the shaping and folding station absolutely straight. This advantage is retained when more than two steel strips are used. If the sheath is made from only one steel strip, however, further devices have to be used to straighten the sheath after shaping and folding on account of differences in the transverse stretching of the strip.

Regardless of whether the sheath is made from one, two or more strips, the folded seam can be made either by folding the confronting longitudinal edges of the strips together or by folding the confronting longitudinal edges into oppositely-open hooks and joining these with another thin steel strip prefolded into a C-shape and engaged thereacross. Either folded seam can be absolutely sealed. A sealing material can be provided in the seam, however, if desired. As a result, there are no points at which corrosion can attack the cable. Moreover, the seams have a high strength against tensile forces circumferential to the sheath so that the sheath can be force-filled with mortar or other material without any problems. The nature of the folded seam is, in any event, however, conventional and can be based on German Federal Pat. No. 12 09 091, for example.

All this can be done, however, separately from preparing and installing the rest of the cable and at a fixed station. This considerably simplifies the work of installing the cable for a suspension bridge, for example. If the cable has seven, tightly-packed tension elements, for example, these can be tensioned between end anchorages on the span and pylon of the bridge first. Then the stationary shaping and folding station is erected at the span anchorage end of the tension elements, for example, and the strip or strips for the sheath fed to the station from a coil, for example, shaped around the tension elements, and provided on each longitudinal edge with a folded seam. As the sheath is thus prepared, it is progressed along the tension elements toward the other pylon end in the example. A simple cable winch can be used for this, for example, by pulling the leading end of the sheath up toward the pylon anchorage at least sufficiently to compensate for the weight of the sheath. A pushing force can also be applied in the shaping and seaming station, however, and this may be sufficient, especially if the shaping and seaming station were, instead, at the upper, pylon anchorage, for example. In this manner, a sheath is obtained in a single length between the two anchorages for the cable, but does not have to be hoisted up into this position with the tension elements or other cable components which also can be hoisted individually, if desired, to reduce still further the difficulty of cable installation.

After the two ends of the sheath have been joined to the anchorages and sealed against them, the cement mortar or other material for filling the space between the tension elements and sheath can be forced into the sheath. The cable installation is then complete.

DESCRIPTION OF THE DRAWINGS

The invention will now be illustrated, but not limited, and further explained by reference to merely-preferred embodiments shown in drawings, in which:

FIGS. 7 and 8 are half cross sections of further preferred embodiments of a cable according to the invention.

DESCRIPTION OF PREFERRED EMBODIMENTS

Figure 1:
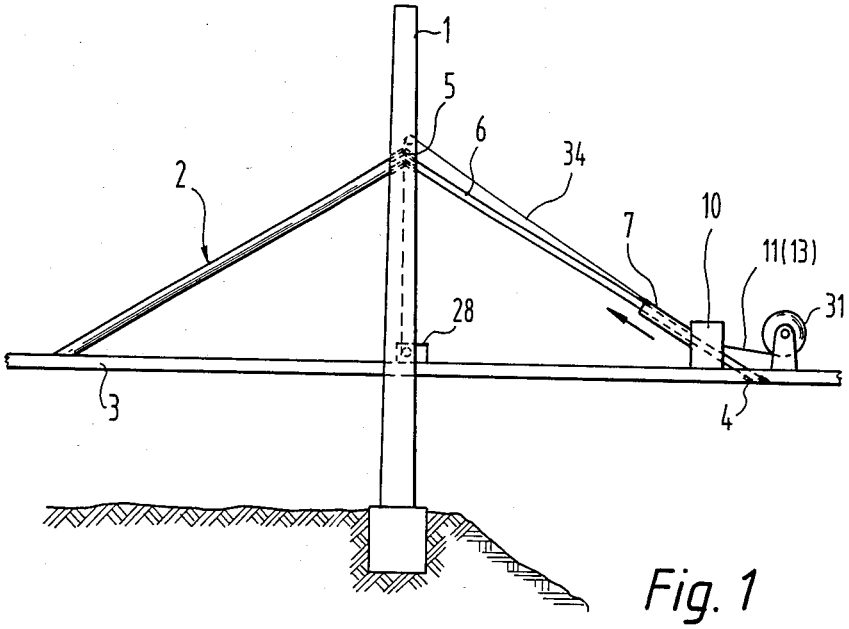
FIG. 1 is an elevation of a cable suspension bridge with cables according to the invention.

A cable suspension bridge of prestressed concrete only partially shown in FIG. 1 has a pylon 1 from which a superstructure, a roadway deck 3, for example, is suspended. The cables 2 are each tensed between an anchorage 4 at the roadway deck and an anchorage 5 at the pylon end.

The cables themselves consist each of seven tension bars 6 of equal diameter, preferably threaded tension bars, around which a tubular sheath 7 of sheet steel is placed in a spaced relationship. The threaded tension bars are composed, in some cases, of several sections joined together by threaded couplings offset from one another lengthwise. The remaining space between the sheath 7 and the tension bars 6 is force-filled with cement mortar 9.

The sheath 7 is composed of two steel strips 11 of semicircular cross section, each bearing on each longitudinal margin a fold 12 of hook-shaped cross section. The two adjoining folds 12 are joined together by means of a metal strip 13 of C-shaped cross section, while a sealing strip 14 of rubber can be inserted between the fold 12 and the strip 13. In this manner a folded seam 15 is formed; cf. FIG. 2.

Figure 5:
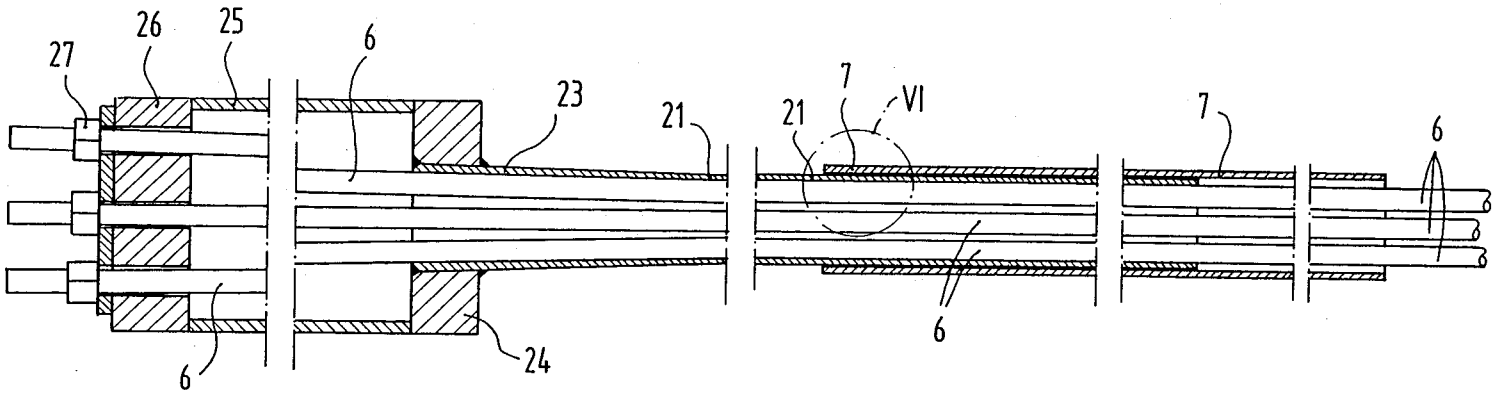
FIG. 5 is a longitudinal elevation, partly in section, of still another preferred cable embodiment.

The production and installation of the cable is performed in the following manner:

The seven tension bars 6 of the cable 2 are laid out on the roadway deck 3 at the beginning of the week's work cycle. To prepare for the anchoring of the cable and the production of the sheathing, a transition tube is pushed onto the end of the tension bar bundle to be associated with the anchor at the pylon end, while on the tension bar bundle end to be associated with the roadway deck anchorage 4, first there is placed a mandrel shown in detail in FIG. 3 and then a transition tube 21 identical to the first. The transition tubes 21 are provided on the ends associated with each anchorage with a trumpet-like flare 23 and an end flange 24 which, when the cable is in its final tensed condition, directly engages a cylinder 25 embedded in concrete, which is capped on the opposite end by an anchor plate 26, as represented diagrammatically in FIG. 5. The two anchorages 4 and 5 are constructed in the same manner.

The uppermost tension bar of the tension bar bundle is held by a nut 27 on the anchor plate 26 of the roadway-end anchorage 4 with enough of it projecting for the tightening that is to follow. The other six tension bars 6 are pushed about 3 meters through the anchoring holes in the anchor plate 26 and at first they are not anchored. Thus, the topmost tension bar projects at the front end of the cable about three meters ahead of the other bars. These bars are suspended from the topmost tension bar at certain intervals by box bands and by the two transition tubes.

To the end face of the uppermost tension bar there is affixed a swivel for a lifting cable about twelve millimeters thick, for example, by means of an explosive driver. The lifting cable runs from a power winch 28 standing on the roadway deck 3 between the pylons 1, over two pulleys situated beside the axis of the pylon 1 at the level of the roadway deck and in the prolongation of the anchoring hole in the anchor plate 26, through the anchoring hole provided in the anchor plate 26 for the uppermost tension bar. After the cable end has been lifted, e.g., by light rotary-tower cranes, the power winch 28 pulls the cable end with about five tons of force to the entrance of the anchor 5 at the pylon end and, with about ten tons of force, through the anchoring hole therein provided, where it is anchored by its nut. Then this tension bar is tightened to the roadway-end anchorage 4 with a tightening press. Due to the sag reduction that is thus produced, the six remaining tension bars 6 can be pulled through the anchoring holes in the pylon anchor, where they can be anchored. The transition tubes 21 are likewise pulled and fastened to the cylinder 25 in each case by means of drawbars. Then the seven tension bars are given their final tension from the anchor 4 at the roadway end. The outer tension bars 6 then lay themselves against the inside wall of the trumpet-like flares 23 in the transition tubes 21.

Figure 3:
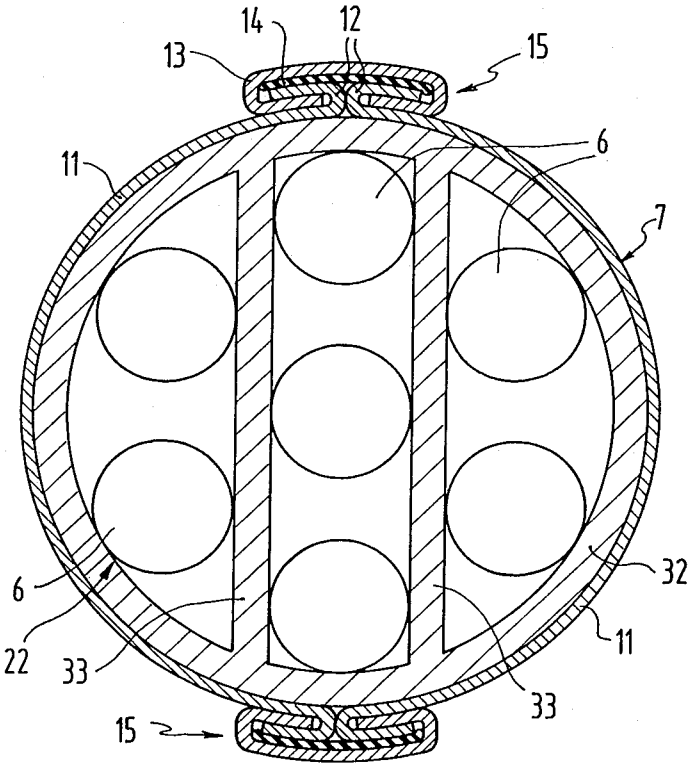
FIG. 3 is an end cross section of another preferred cable embodiment.

Then a shaping and seaming station 10 is positioned close to the roadway-end anchor 4, and in it the sheath 7 is shaped from four steel strips with the two folded seams 15. The steel strips are supplied on coils of which only one coil 31 is diagrammatically represented here. The shaping of the sheath 7 and the folding of the folded seam 15 is performed by shaping and seaming tools which are not shown in detail herein, the sheath 7 being given its final shape with the aid of the mandrel 22 resting on the tightened threaded bars 6, as shown in FIG. 3. The mandrel 22 itself has a steel tube 32 about 20 to 30 centimeters long, with an outside diameter corresponding to the inside diameter of the sheath 7. The steel tube 32 is divided longitudinally by two partitions 33 running parallel to the tube axis. The entire mandrel 22 is thus divided into three chambers. In the left one in FIG. 3, two threaded bars run, three run in the middle chamber, and in the right chamber again two threaded bars. The threaded bars lie in each case on the steel tube and in some cases against the partitions in the mandrel 22, so that the mandrel is fixed in its position. The material strips 11 for the sheath are introduced into the shaping and seaming station 10 and shaped to a semicircular cross section by shaping means here not shown, with the aid of the steel tube 32, while the longitudinal margins are bent to form the hook-shaped folds 12. The material strips 13 are pre-folded in the shaping and seaming station to C-shaped cross sections, and the material strip 11 is placed over the folds 12 of two abutting edges of the material strips 11. The folded seam 15 thus formed is then pressed flat by powerful hand presses, the two partition walls 33 and the portion of the steel tube 32 between them serving as backing means. The pressing of the folded seam is performed cyclically, the sheath being stopped during each pressing.

The sheath 7 thus made is advanced by rollers or the like within the shaping and seaming station 10 along the tightened tension bars 6 toward the pylon-end anchor 5, as indicated by the arrow in FIG. 1. By means of a pull cable 34, which is applied to the front end of the sheath and guided over a cable pulley on the pylon 1 to the cable winch 28, at least the inherent weight of the sheath 7 is compensated.

Figure 6:
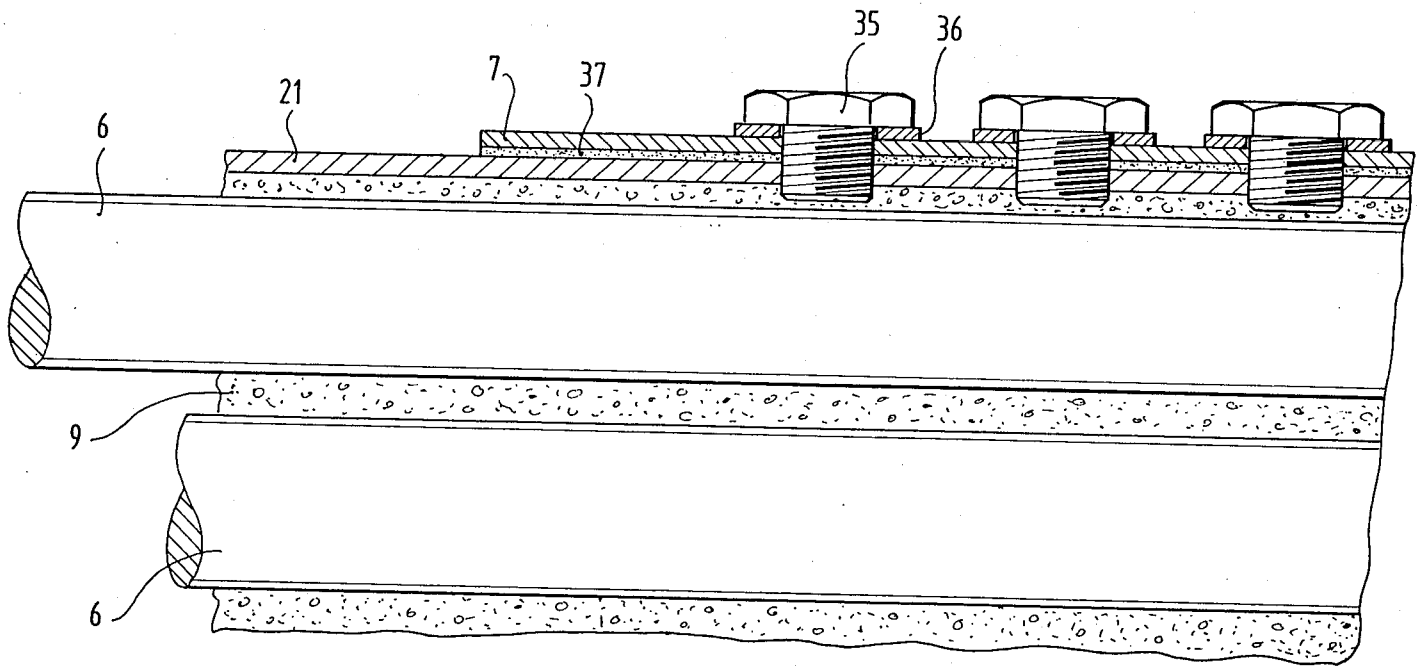
FIG. 6 is an enlarged elevation, partly in section, of a portion of the embodiment shown in FIG. 5.

When the front end of the sheath 7 reaches the pylon-end anchor 5 with the transition tube 21, the sheath is first pushed as far as possible over the transition tube 21. Then the sheath is severed at the shaping and seaming station end. After the shaping and seaming station has been removed, the open end of the sheath 7 at the roadway-end anchor 4 is pushed over the transition tube at that point. In any case it is not necessary to remove the mandrel shown in FIG. 3 after the shaping and seaming station has been removed. Instead, it can be left as a component of the finished cable. Then the sheath 7 is joined to the two transition tubes 21; cf. FIGS. 5 and 6.

For this junction, the sheath 7 overlaps the transition tube on about a third of its length, amounting usually to about one and one-half meters. The sheath 7 and the transition tube are joined together by simple machine screws 35 whose thread reaches into the interior of the transition tube 21. Between the screw head and the sheath there are also provided appropriately formed washers 36. The number of screws 35 will depend on the forces which are to be withstood by the transition tube 21 and the sheath 7 in the finished cable. The interstice between the transition tube 21 and the sheath 7 is filled with a sealant 37, such as epoxy resin, for example, by which the two tubes are additionally cemented together. If the tubes are joined and sealed against one another in this manner, the hollow space between the tension bars 6 and the sheath 7 is injected with mortar 9 from the roadway anchor 4.

In the case of a cable as described, the forces of a static and dynamic nature which are applied to it are withstood by the tension bars and partially also by the sheath. In the case of sheaths which are formed from sheet steel strips about four millimeters thick, their share amounts to about 15%.

Figure 2:
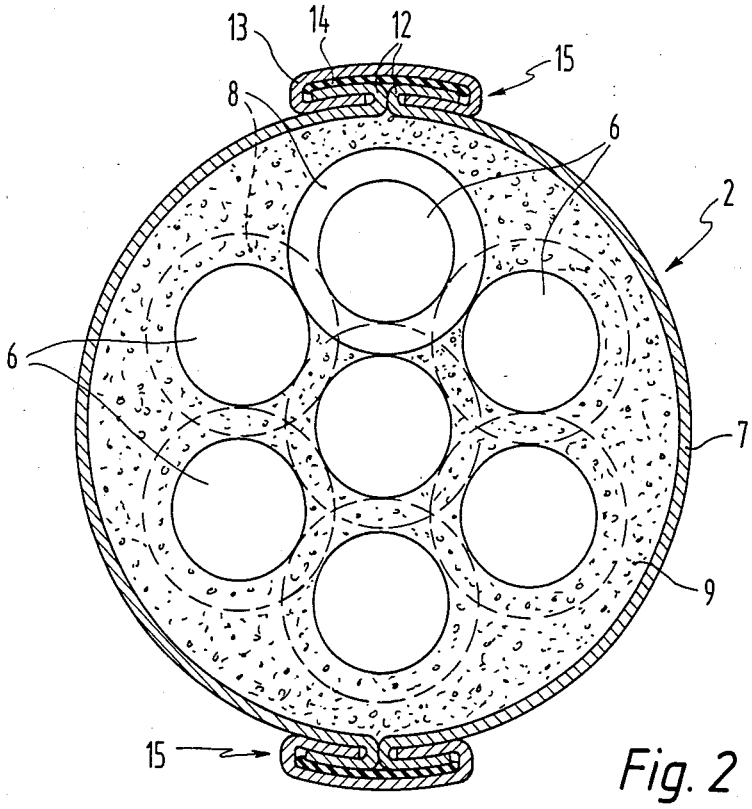
FIG. 2 is an end cross section of a preferred embodiment of a cable according to the invention.

The process of installing the sheath and injecting it with mortar can be carried out independently of the schedule of the preliminary construction at the worksite. Instead of the relatively thick tension bars, bundles of thinner tension bars can be used, so that, say, each tension rod of FIG. 2 is replaced by a bundle of seven steel bars. Furthermore, more or less thin strands of wire can be used instead of the tension bars.

Figure 4:
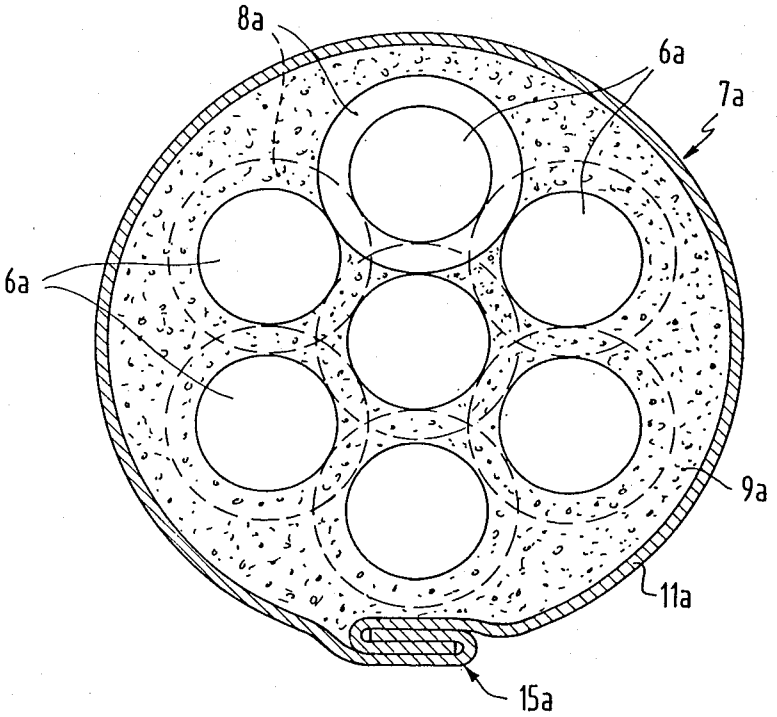
FIG. 4 is an end cross section of still another preferred cable embodiment.

FIG. 4 represents another embodiment of a sheath 7*a* with a folded seam 15*a*. This sheath is formed from a single steel strip 11*a* whose longitudinal margins are formed into folds 12*a* of hook-shaped cross section, which engage one another to form the folded seam 15*a*. The sheath 7*a* is, as shown in FIG. 1 and described above, shaped in the stationary shaping and folding station; the folded seam 15*a* is also pressed there. The pressing is performed by means of two pressure rolls or stamps, one of the rolls being mounted inside of the sheath 7*a*. The tension bars are bundled together in the area of the shaping and folding station, and carried on the side of the sheath opposite the folded seam 16*a*, so that sufficient space remains inside of the sheath tube 7*a* for the pressing roll. The installation of the cable is performed as in the above embodiment.

Even if the use of the cable especially for suspension bridges is mentioned above, it is usable in other fields as well. One additional and advantageous field of application is to be seen in conjunction with band suspension bridges as described in U.S. Pat. No. 4,480,348. In band suspension bridges, a steel-concrete plate shaped according to a cable line is used and runs between abutments in which the sheathing is anchored, or it runs between abutments and pillars. This tension band can be replaced according to the invention by a plurality of parallel cables. Then a saddling can be placed on the tension band as in the above patent, and will bear the roadway deck.

In the embodiments according to FIGS. 7 and 8, respectively, each sheath 7*b*, 7*c* is composed of two steel strips 11*b*, 11*c* of semicircular cross section each bearing on each longitudinal margin a radially projecting flange or fold 12*b*, 12*c*. The adjoining folds 12*b* are screwed together by screws 41, the folds 12*c* are welded together at 42. The sheath 7*b* 7*c* is progessively formed and advanced along the tensioned tension elements as described above.

What is claimed is:

1. A process for making a cable for a suspension structure comprising:

providing at least one tension element, anchoring the ends of the same to the suspension structure, and tensioning the tension element;

providing at least one continuous strip with a longitudinal axis and a curved shape along said longitudinal axis of said continuous strip, said continuous strip positioned in an arcuate position about the tension element; and progressively forming said at least one continuous strip into a sheath about the tension element with a space therebetween, confronting longitudinal edges along the continuous strip being bonded together;

advancing the sheath along the tension element as so progressively formed; and filling the space between the tension element and the sheath with a filling material.

2. The process of claim 1, wherein tensioning the tension element further comprises anchoring ends of the same to the suspension structure.

3. The process of claim 1, wherein forming the continuous strip into the sheath further comprises folding the fold along each confronting longitudinal edge of the sheath together.

4. The process of claim 1, wherein forming the continuous strip into the sheath further comprises folding the fold along each confronting longitudinal edge of the sheath into an oppositely-opening hook.

5. The process of claim 4, and further comprising engaging a C-shaped strip across the oppositely-opening hooks along each of the confronting edges.

6. The process of claim 1, wherein forming the continuous strip into a sheath comprises progressively forming the same in a stationary shaping and folding station and advancing the sheath along the tension element as so progressively formed.

7. The process of claim 2, wherein forming the continuous strip into a sheath comprises progressively forming the same in a stationary shaping and folding station and advancing the sheath along the tension element as so progressively formed.

8. The process of claim 3, wherein forming the continuous strip into a sheath comprises progressively forming the same in a stationary shaping and folding station and advancing the sheath along the tension element as so progressively formed.

9. The process of claim 4, wherein forming the continuous strip into a sheath comprises progressively forming the same in a stationary shaping and folding station and advancing the sheath along the tension element as so progressively formed.

10. The process of claim 5, wherein forming the continuous strip into a sheath comprises progressively forming the same in a stationary shaping and folding station and advancing the sheath along the tension element as so progressively formed.

11. The process of claim 6, wherein advancing the sheath along the tension element comprises pulling the same therealong with a hoist at least sufficiently to compensate for the weight of the sheath.

12. The process of claim 7, wherein advancing the sheath along the tension element comprises pulling the same therealong with a hoist at least sufficiently to compensate for the weight of the sheath.

13. The process of claim 1, wherein providing and tensioning the at least one tension element comprises providing and tensioning plural tension elements.

14. The process of claim 13, wherein tensioning the plural tension elements comprises hoisting the same into the suspension structure individually.

* * * * *